United States Patent [19]

Ludwig

[11] Patent Number: 4,627,473

[45] Date of Patent: Dec. 9, 1986

[54] POWER LOOM TEMPLE

[75] Inventor: Hubertus Ludwig, Lindau-Bodolz, Fed. Rep. of Germany

[73] Assignee: Lindauer Dornier Gesellschaft mbH, Lindau, Fed. Rep. of Germany

[21] Appl. No.: 651,456

[22] Filed: Sep. 17, 1984

[30] Foreign Application Priority Data

Sep. 29, 1983 [DE] Fed. Rep. of Germany ..... 3335208

[51] Int. Cl.[4] ..... D03J 1/22

[52] U.S. Cl. ..... 139/294

[58] Field of Search ..... 139/292, 294, 295, 296, 139/297, 298; 26/71

[56] References Cited

U.S. PATENT DOCUMENTS 914,509 3/1909 Prest ..... 139/294
1,774,435 8/1930 Glattfelter ..... 139/294

FOREIGN PATENT DOCUMENTS 60351 7/1913 Austria .
1533049 7/1967 Fed. Rep. of Germany ..... 139/294
370863 10/1930 United Kingdom .
477308 3/1936 United Kingdom .
544141 3/1942 United Kingdom .
642721 9/1950 United Kingdom ..... 139/294
720208 12/1954 United Kingdom .

*Primary Examiner*—Henry S. Jaudon

[57] ABSTRACT

The cover for the retaining member of a temple has a threaded rod either rotatably or fixedly attached to each cover leg. The threaded rod rests on the fabric. The rod preceding the retaining member in the direction of advance of the fabric advances the point at which the spreading effect of the temple becomes operative. The threaded rod affixed to the leg of the cover which follows the retaining member in the direction of advance of the fabric relieves the retaining member of load and thereby decreases the possibility of damage to the fabric. The cover with threaded rods is useful whether the retaining member contacts the bottom of the fabric, with the cover on top, or the retaining member contacts the top side, with the cover below, and the threaded rods riding on the underside of the fabric.

4 Claims, 2 Drawing Figures

POWER LOOM TEMPLE

FIELD OF THE INVENTION

The present invention relates to temples or expanders for power looms.

BACKGROUND OF THE INVENTION

In power looms, temples are arranged at both sides of the machine at the edge of the finished fabric in order to minimize contraction or shrinkage, that is to maintain the same width in the finished fabric as that of the warp in the reed. Many different types of temples are commercially available. Generally, they consist of a cylindrical retaining member whose surface engages the edge of the fabric over a predetermined gripping angle. The surface is so designed that an outward pull is exerted on the edge of the fabric. Such retaining members may, for example, be thread rollers or, alternatively, a spinous surface may be created by a plurality of needle wheels.

The cylindrical retaining member is usually provided with a cover having legs resting on the fabric on both sides of the retaining member and defining the area covered by the temple. The construction of the retaining member is to a great extent determined by the type of fabric being manufactured. Difficulties arise when different fabrics are to be manufactured on the same loom and the built-in temples are not suitable for all of these. When fine dense fabrics are being woven, there is often the danger that the needles or spines on the surface of the retaining member will make holes in the fabric.

SUMMARY OF THE INVENTION

It is an object of the present invention to eliminate the above-mentioned drawbacks to the greates extent possible and to minimize the damage to the fabric in the area covered by the temple.

In accordance with the present invention, a temple having a substantially cylindrical retaining member which engages the edge of the fabric over a predetermined gripping angle is provided with an improved cover. The cover has a top and two legs extending from the top towards the fabric. A threaded rod extending in a direction approximately parallel to the retaining member is provided at the fabric-facing end of each leg. The threaded rods rest on the fabric. It must be understood that the invention is equally applicable whether the retaining member contacts the bottom of the fabric, with the cover on top, as illustrated, or the retaining member contacts the top side, with the cover below and the threaded rods riding on the underside of the fabric. In the latter case, the "top" of the cover would of course be its bottom.

The threaded rods on the cover improve the operation of the conventional temple in two ways. The first threaded rod causes the fabric to be engaged and the broadening effect to take place only a few millimeters after the tie-up point. In temples utilizing conventional covers lacking the threaded rods, the broadening effect takes place later, that is when the fabric is engaged by the cylindrical retaining member. Causing the broadening effect to be applied as closely as possible following the tie-up point minimizes the possible shrinkage.

The second threaded rod at the end of the temple creates an additional broadening effect which causes the force exerted on the cylindrical retaining member to be decreased, thereby facilitating the removal of the fabric from the retaining member. The risk of damaging the material is greatly diminished. Since the force on the cylindrical retaining member is decreased, a lesser pull is required, thereby decreasing the wear of the retaining member.

The novel features which are considered as characteristic for the invention are set forth in particular in the appended claims. The invention itself, however, both as to its construction and its method of operation, together with additional objects and advantages thereof will best be understood from the following description of specific embodiments when read in connection with the accompanying drawing.

DESCRIPTION OF THE PREFERRED EMBODIMENT

Figure 1:
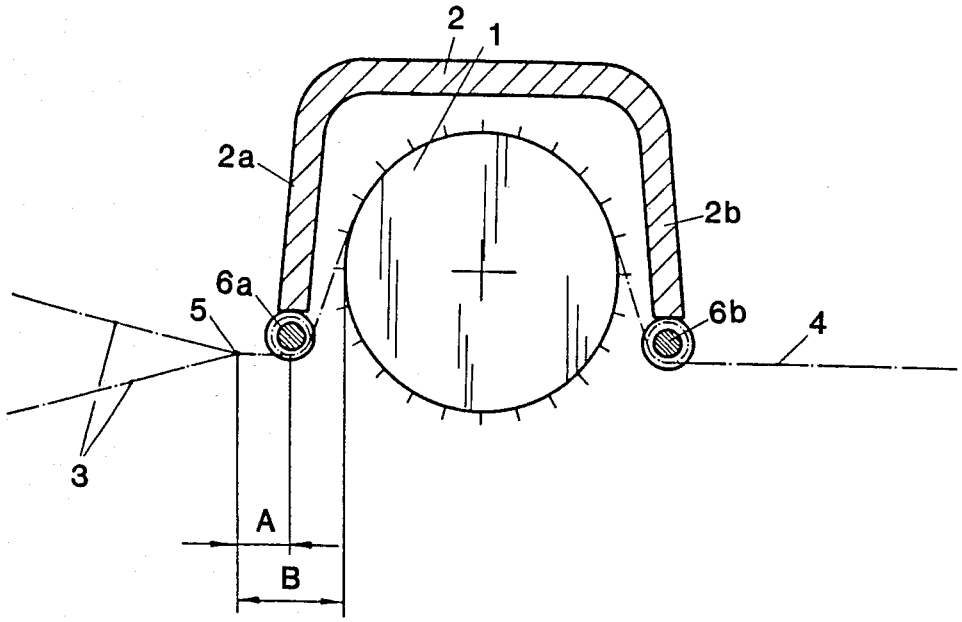
FIG. 1 is a schematic diagram showing a cross-section of the temple in the direction of filling.

While only a single temple is illustrated in FIG. 1, a similar temple is provided on the other side of the loom. As illustrated in FIG. 1, a cylindrical retaining member 1 has a cover 2. The dash-dot lines indicate a shed 3 with its warp threads. The tie-up point 5 is indicated at the tip of shed 3. The finished fabric 4 commences at tie-up point 5. Fabric 4 is pulled over a part of the circumference of cylindrical retaining member 1. In the embodiment it is assumed that retaining member 1 consists of needle rollers whose needles engage the edge of fabric 4 and cause the fabric to be stretched in the direction of its width. The particular construction used for the retaining member is of no special importance to the present invention. Any type of retaining member may be used.

Cover 2 has two legs *2a, 2b,* which extend from its top toward fabric 4. A threaded rod, *6a, 6b,* is provided at the ends of legs *2a* and *2b,* respectively. The rods *6a* and *6b* extend in a direction substantially parallel to the axis of cylindrical retaining member 1. The thread direction of the threaded rods is selected so as to provide an outward pull on the portion of fabric 4 in contact therewith. The distance labeled A in FIG. 1 is the distance between the first threaded roller *6a* and tie-up point 5. This distance is about 2 to 3 millimeters in practice and constitutes the distance following the tie-up point after which the broadening effect commences. B indicates the distance between tie-up point 5 and the location at which retaining member 1 starts to engage fabric 4. This distance is generally between 6 and 7 millimeters and constitutes the distance at which the broadening effect would take place in the absence of the threaded rollers of the present invention. It is thus evident that the broadening effect takes place much sooner when a cover according to the present invention is used and that shrinking of the fabric in the direction of its width is thereby decreased considerably.

The second threaded rod, *6b,* is arranged at the exit side of the temple. As previously mentioned, this facilitates the removal of the fabric from the retaining member.

Figure 2:
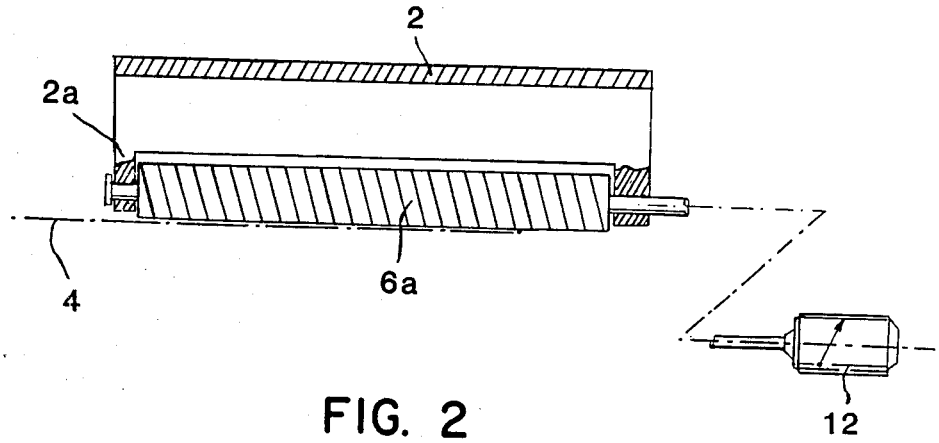
FIG. 2 shows a rotary rod mounted in the cover leg.

Covers having the threaded rods described above are arranged on the left and right side of the loom. The rods on the left side have a thread direction opposite to that of the rods on the right side. It should be mentioned that the threaded rods need not be fixedly attached to the legs of the cover, (e.g.. by welding) but may be rotatably connected thereto. This is illustrated in FIG. 2, which is a longitudinal cross section illustrating rod 6*a* rotatably mounted in the ends of leg 2*a* of cover 2. The rod is driven by an electromotor 12 which, as indicated by the arrow, has a variable speed. Fabric 4 is located underneath rod 6*a* and makes contact therewith. The second threaded rod 6*b* is not illustrated here, since its mounting and connection to the drive of rod 6*a* are obvious. For the embodiment of FIG. 2, it is important that a relative velocity be maintained between the speed of advance of the fabric and the rotational speed of the threaded rods. Adjustment of this relative speed results in an additional control of the broadening or spreading effect of the temple.

While the invention has been illustrated in a preferred embodiment, it is not to be limited to the elements and structures shown, since many variations thereof will be evident to on skilled in the art and are intended to be encompassed in the present invention as set forth in the following claims.

I claim:

1. In a power loom, a pair of temples maintaining the width of a fabric having a pair of edges extending in a lengthwise direction said temples each having a substantially cylindrical rotary retaining member engaging said edge over a predetermined gripping angle and exerting a force in a direction perpendicular to said lengthwise direction, said temples each further having a cover covering said gripping angle and having a respective first and second end facing said fabric, the improvement comprising a first and second threaded rod respectively arranged at said first and second end, said rods extending in a direction substantially parallel to said retaining member and making contact with said fabric; and wherein said fabric is transported in said lengthwise direction at a predetermined transport speed relative to said rods so that said rods stretch said fabric in the direction of said width.

2. An improved temple as set forth in claim 1, wherein said threaded rods are fixedly fastened to said ends of said cover.

3. An improved temple as set forth in claim 1, wherein said first and second threaded rods are mounted for rotation at a predetermined rotational speed.

4. An improved temple as set forth in claim 1, wherein said fabric has an upper surface and an underside; and wherein said retaining member and said rods engage said underside and said upper surface, respectively.

* * * * *